US005497167A

United States Patent [19]

Luoma

[11] Patent Number: 5,497,167

[45] Date of Patent: Mar. 5, 1996

[54] ANTENNA FOR MOUNTING ON A VEHICLE WINDOW

[75] Inventor: Ari-Matti Luoma, Kempele, Finland

[73] Assignee: Window Antenna Oy, Kempele, Finland

[21] Appl. No.: 219,297

[22] Filed: Mar. 28, 1994

Related U.S. Application Data

[63] Continuation-in-part of Ser. No. 958,127, Dec. 29, 1992, abandoned.

[30] Foreign Application Priority Data

Aug. 1, 1990 [FI] Finland ..... 903836

[51] Int. Cl.[6] ..... H01Q 9/38

[52] U.S. Cl. ..... 343/828; 343/713; 343/829

[58] Field of Search ..... 343/713, 826, 343/828, 830, 831, 833, 790, 791; H01Q 1/32, 9/00, 9/30, 9/38

[56] References Cited

U.S. PATENT DOCUMENTS 2,505,751 5/1950 Bolljahn ..... 343/790
4,914,447 4/1990 Ishii et al. ..... 343/713

*Primary Examiner*—Michael C. Wimer
*Attorney, Agent, or Firm*—Pollock, Vande Sande & Priddy

[57] ABSTRACT

An antenna, particularly a mobile telephone antenna mounted onto the window of a motor vehicle. The antenna comprises a H-shaped ground plane turned to the horizontal plane and a vertical radiator essentially perpendicular to it and mounted at a distance from it. On each side of the vertical radiator there is at least one shadow element parallel to the vertical radiator, the said shadow elements being used to adjust the antenna's impedance to the impedance of the connecting cable to be used.

8 Claims, 4 Drawing Sheets

ANTENNA FOR MOUNTING ON A VEHICLE WINDOW

RELATED APPLICATIONS

This is a continuation-in-part of U.S. patent application Ser. No. 07/958,127, filed Dec. 29, 1992, now abandoned.

BACKGROUND OF THE INVENTION

The invention relates to an antenna for transmitting and receiving a radio frequency while mounted on a window of a vehicle. The basic construction of the antenna is of the well known Marconi type consisting of a vertical radiator and an essentially horizontal grounding element at one end of the radiator, but apart of it, whereby said vertical radiator and grounding element are connected to a radio apparatus with separate connecting lines.

This type of antenna is widely used in transmission applications between a base station and a mobile vehicle, due to the benefits involved in the antenna of the type in question. One of these applications is for mobile telephones mounted on vehicles.

One important parameter of a mobile telephone antenna intended to be used in a vehicle is its radiation pattern. Radiation should be concentrated in the horizontal direction as much as possible because the base station is generally at the horizon. Moreover, the radiation pattern in the horizontal plane should be a wide one and symmetrical in relation to the vertical plane in order for the antenna to function properly regardless of the angle formed between the vehicle's direction of travel vector and the directional vector between the vehicle and the base station.

A radiation pattern of the type described above can be achieved by using an antenna of the mentioned Marconi type mounted in the middle of the roof of the vehicle, whereby the roof forms the grounding element of the antenna. This application results in good directional radiation patterns in the horizontal plane, with a minor disadvantage, that the maximum radiation is directed slightly too pronounced upwards from the horizontal plane.

One major problem associated with the telephone antennas fastened onto the external body parts of motor vehicles is the requirement for bored holes. Solutions to this problem have been presented; including the use of suction cups, magnets, etc., in attaching the antenna to the external body parts of motor vehicles. These are, however, rather clumsy solutions and the antenna cable must first pass along the roof of the motor vehicle and from there, by way of the door seal, into the cabin of the vehicle and then to the mobile telephone.

Another prior art solution consists of fastening the antenna onto the outside of the motor vehicle's window and fastening a counterpart onto the inside of the window and the signal is transmitted through the glass.

In addition, U.S. Pat. No. 4,746,925 describes a mobile telephone antenna for mounting onto the window of a motor vehicle composed of two dipole antenna elements. One end of either of the two dipole antenna elements is connected to the antenna cable's central conductor by means of its central electricity conductor and the other dipole antenna element's end is connected to the antenna cable's sheath by means of a first electricity conductor serving as an electrical projector installed adjacent to the central electricity conductor. Additionally, there is, on the other side of the central electricity conductor, a second electricity conductor connected to the antenna cable's sheath also acting as an electrical protector. Additionally, transformer elements protrude from the first and second electrical protectors. An antenna of this type possesses a typical dipole directional pattern; that is to say, a sphere, which means that considerable amounts of energy are directed upwards and downwards in addition to the horizontal plane. The effective radiation area of this type of an antenna remains relatively small in relation to the overall space required by it. The dipole elements form the radiation space while the rest of the antenna is unnecessary space in this respect. The part of the antenna between the dipole elements and the antenna cable forms a balun by means of which the antenna is tuned to a single frequency. Moreover, the structure in question is relatively complicated.

There is thus still a need for an antenna for telecommunications between vehicles and base stations, which antenna would provide the beneficial radiation properties of the Marconi type antenna, and the feasibility of the window mounted antenna of the U.S. Pat. No. 4,746,925. One reason for the absence of an antenna construction having the aforementioned benefits might be the fact that, as the inventor has noted, when an antenna of Marconi type is fabricated according to the conductive foil technique described in the named U.S. Pat. No. 4,746,925, the resulting antenna is very to difficult to construct to match with the remaining parts of the radio apparatus, especially with the standardized antenna cable properties. The main reason for this incompatibly seems to be the high impedance of the antenna, which is in the order of 75 ohms, as compared with the standard 50 ohm cable impedance. This fact causes a discontinuity problem between the antenna and the cable connected to it. The discontinuity causes wave reflection and leads to a decisive weakening of the communication achievable with the radio apparatus connected to an antenna of the tested type.

The antenna as such has proven to have a very good radiation pattern of a wide, flattened torus type, which is even more flattened that of an antenna of Marconi type mounted on a vehicle roof.

The discontinuity problem has now been solved by the present invention.

The basic construction of the antenna needs to be dimensioned carefully taking into consideration the frequency to be transmitted and received by the antenna, as well as the environment where the antenna is to be working. The most important environmental feature is the dielectric properties of the window glass on which the antenna is intended to be mounted. The dielectric properties, i.e. the velocity factor of the glass is the main feature, in addition to the transmission frequency, affecting the dimensions of the antenna.

SUMMARY OF THE INVENTION

The main element in the antenna is the vertical radiator or driven element, and its length is dimensioned to match the signal frequency to be transmitted. In dimensioning the radiator element one can apply the well known formula according to which the wave length $\lambda$ in meters equals to 300/f, where f is the frequency in MHz. The correct dimension for the length of the radiator is then calculated taking the dielectric properties of the window glass of the actual vehicle into consideration. Usually the velocity factor correlating to the dielectric properties of a vehicle window is of the order of 0.717. After the velocity factor of the window glass has been taken into consideration as a correction factor, the length of the antenna corresponds to a length resonating at the frequency to be transmitted. In the following description this corrected length is referred to as an antenna wave length in connection with the antenna's dimensions, when the antenna's actual length corresponds to the full wave to be transmitted.

The width of the vertical radiator is essentially smaller than the length, usually in order of some millimeter.

The width of the vertical radiator is not very critical to the properties of the antenna. Also the thickness of the conductive foil, of which the antenna elements are fabricated is not critical, but usually it is in order of some tenths of millimeters.

The grounding element of the antenna consists of essentially the same type of conductive foil strips as the vertical radiator. The grounding elements project from the vicinity of one end of the vertical radiator essentially horizontally as well as equally to both sides of the vertical radiator. The distance of projecting is not very critical, but is in order of ⅛ to ½ times the antenna wave length to both sides from the vertical radiator.

When adhered to the inner surface of a vehicle window, and connected to a mobile telephone by a coaxial cable, the antenna described above has proven to have a wide and properly formed radiation pattern. The antenna is connected to the cable so that the central line of the cable connects the end of the vertical radiator nearest to the grounding element to the telephone apparatus, whereas the sheath of the cable is connected to the grounding element of the antenna.

The remaining problem is, however, the impedance of the antenna, which does not match to the impedance of the standardized cable. This problem has been solved according to the invention by providing the vertical radiator with parasitic elements, which cover each side of the vertical radiator a certain distance from it. These parasitic elements consist of corresponding conductive strips as the vertical radiator and the grounding element. The parasitic elements are placed side by side of the vertical radiator at a distance essentially corresponding to the width of the vertical radiator or the parasitic elements which widths can be essentially equal. The minimum requirement is one parasitic element on each side of the vertical radiator. The number of the elements can, however, be higher, but even on each side of the vertical radiator.

The aforementioned width of the shadow elements is not very critical, but the length of these elements, and especially their position in the length direction of the vertical radiator have proven to be essential to the properties of the antenna.

The tests conducted by the antenna of the type in question, have shown that the parasitic elements are to be positioned in respect with the vertical radiator so that they project from the peak radiation power point nearest to the grounding element to any following peak radiation power point on the vertical radiator. As the voltage and the current in a resonating antenna are in opposite phases, the first radiation power peak point, is ⅛ of the antenna wave length from the connecting end of the vertical radiator, and thereafter after a length of each ¼ of the antenna wave length. This fact leads to the conclusion that the minimum length for the vertical antenna is ½ of the antenna wave length. When constructed according to these principles the antenna of the invention has proven to posses an impedance essentially closer to impedance of the cable to be used. By selecting the number of the parasitic elements it is possible to receive an impedance value for the antenna exactly the same as the impedance of a standardized cable.

In the following, the invention is described in more detail referring to advantageous non-limiting embodiments shown in the appended Figures.

Figure 1:
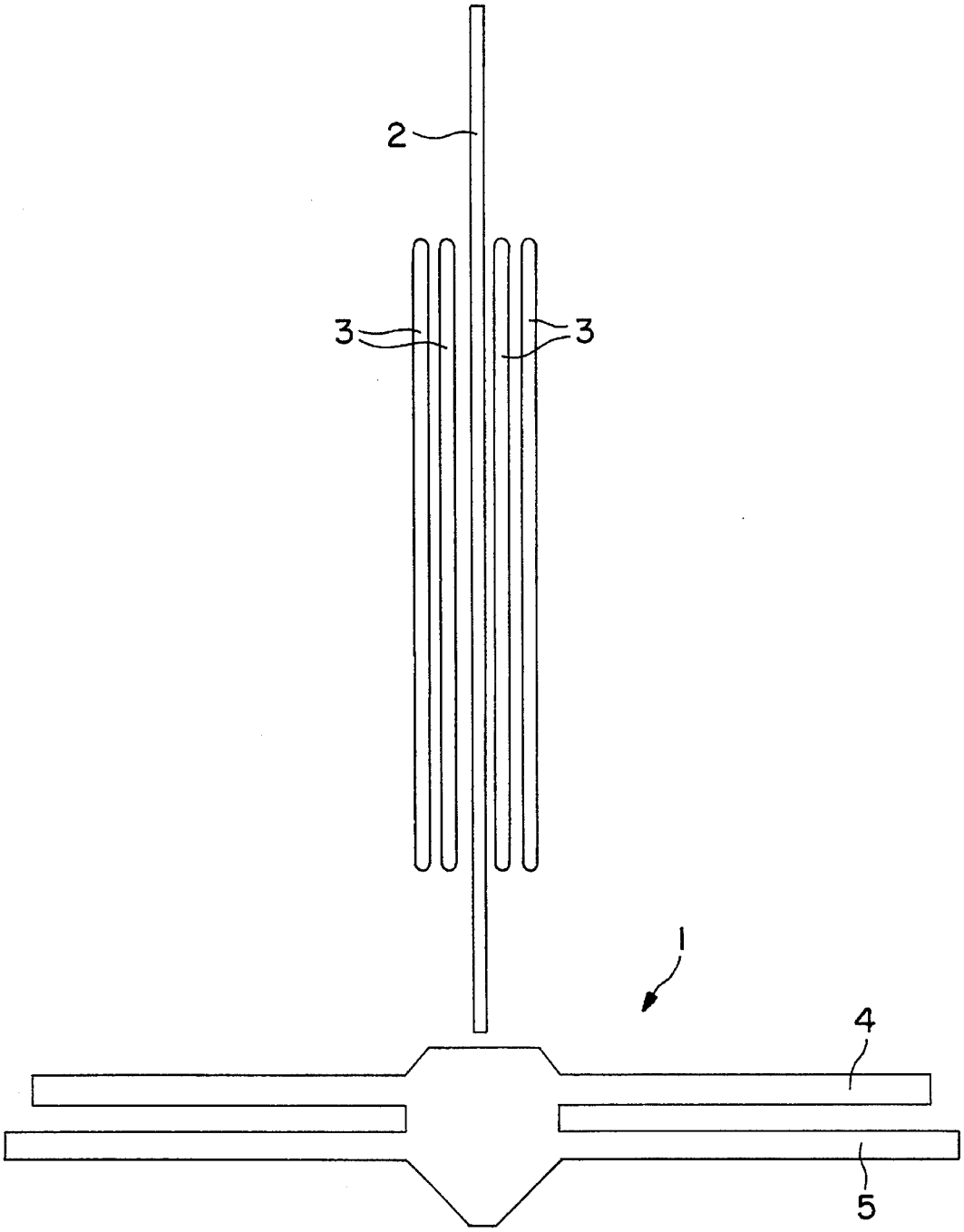
FIG. 1 shows an antenna in accordance with one embodiment of the invention.

The vehicle window mountable antenna in accordance with the invention shown in FIG. 1 consists of a ground plane 1 taking the form of a letter H essentially turned to the horizontal plane and of a vertical radiator 2 installed essentially perpendicular to it. On each side of the vertical radiator 2 at a distance from it are parasitic elements 3 installed parallel to the vertical radiator, two on each side of the radiator. These parasitic elements 3 adjust the antenna's impedance to match that of the antenna cable. Elements 3 have hardly any influence on the antenna's radiation pattern. The central conductor of the coaxial cable is connected to the base of the radiator 2 and its sheath is connected to the middle of the ground plane 1. The radiator 2 is installed midway along the ground plane's horizontal direction.

The following is an example of the antenna element's dimensions, for a 450 MHz mobile telephone and proven by measurements to be advantageous, of the parts of a vehicle window mountable antenna in accordance with the invention.

The antenna in accordance with the preferred embodiment of the invention has been executed in such a way that the radiator 2 and the parasitic elements 3 are formed of copper tape about 4 mm in width and the ground element 1 is formed of copper tape about 5 mm in width having the form of a letter H and having been turned essentially to the horizontal plane. The parallel arms 4, 5 of the ground element are also about 5 mm apart from one another. The parasitic elements 3 are at a distance of about 2 mm from the radiator 2 and 2 mm from one another. Elements 3 are not in electrical contact with one another and neither are they in electrical conducting contact with the radiator 2. The point 4 of the ground element 1 nearest to the base of the radiator 2 is at a distance of about 10 mm from the base of the radiator 2. Distance here means the distance between the elements' opposite edges; that is to say, the free space left between them. While the width of the antenna elements and the distance between them do not constitute very critical parameters, the calculations presented below, computed with measurements as the basis, are established on the dimensions. Neither is the thickness of the copper tape a very critical factor. As an indication of the order of the dimensions involved, the ratio of the tape width to its thickness is approximately 40:1.

The frequency of 455.5 MHz in a mobile telephone network results in a wave length in the air of approximately 300/455.5=0.659 meters. Taking into account the velocity factor of the vehicle's window glass, which depends on the glass and is approximately 0.717 in a car window glass, the length of the radiator 2 (antenna wave length), reduced by the velocity factor, is 659×0.717=472 mm. Because measurements have shown a ¾ wave length radiator to be advantageous and also because its length makes it suitable for mounting onto vehicle windows, the length of the radiator 2 is obtained as ¾×472=350 mm. The appropriate length of the elements 3 is 255 mm which is slightly more than ½ the wave length (coefficient 1/1.86). Since the parasitic elements 3 are not in conductive contact with the other parts of the antenna, their capacity coupling is smaller and the wave length in them is thus greater than the length of the radiator 2 computed in the corresponding manner. The elements 3 are installed at the same height with respect to their bases and so that the free space on the side of the ground plane 1 of the radiator 2 is approximately 40 mm. It is necessary for the parasitic elements 3 to extend to the level of the first radiation capacity maximum of the radiator 2. The length of the arm 4 of the H-shaped ground element 1 turned to the horizontal plane and, being nearest to the radiator 2, is advantageously approximately 180 mm and that of the lower arm 5 is approximately 260 mm.

Here the ground element 1 functions, together with the coaxial cable, mainly as a grounding capacitance and the influence of the window glass velocity factor on the grounding element is fairly negligible. The horizontally oriented H-structure of the grounding element 1 and the above mentioned dimensioning serve to efficiently eliminate disturbances resulting from variation in the length of the antenna cable.

These arrangements make it possible to achieve an antenna impedance of 50 ohms at a resonance frequency of 455.5 MHz; that is to say, the antenna is adjusted to the most commonly employed antenna cable whose wave impedance is 50 ohms.

By employing the above mentioned principle, the antenna in accordance with the invention can also be designed for a 900 mHz mobile telephone and any other frequency within the range of 300 MHz–3 GHz.

In this type of a construction, the coupling of the parasitic elements 3 to the radiator 2 is inductive and capacitive by nature. These shadow elements 3 do not influence the antenna wave length of the radiator 2.

In the antenna in accordance with the invention, the radiator 2 and the parasitic elements 3 are located between an imposition film and a protective paper. Once the protective paper is stripped away, the imposition film is used in pressing the radiator 2 and the parasitic elements 3 onto the desired place on the window so that the adhesive on them fastens them onto the glass. Once this has occurred, the imposition film can be removed. Thus, the manufacturing of the antenna is quite simple and readily lends itself to automation. Mass-production of the antenna can be confined to just one size so that the protective paper bears the cutting outlines for instance for antennas appropriate for 450 MHz and 900 MHz antennas.

Figure 2:
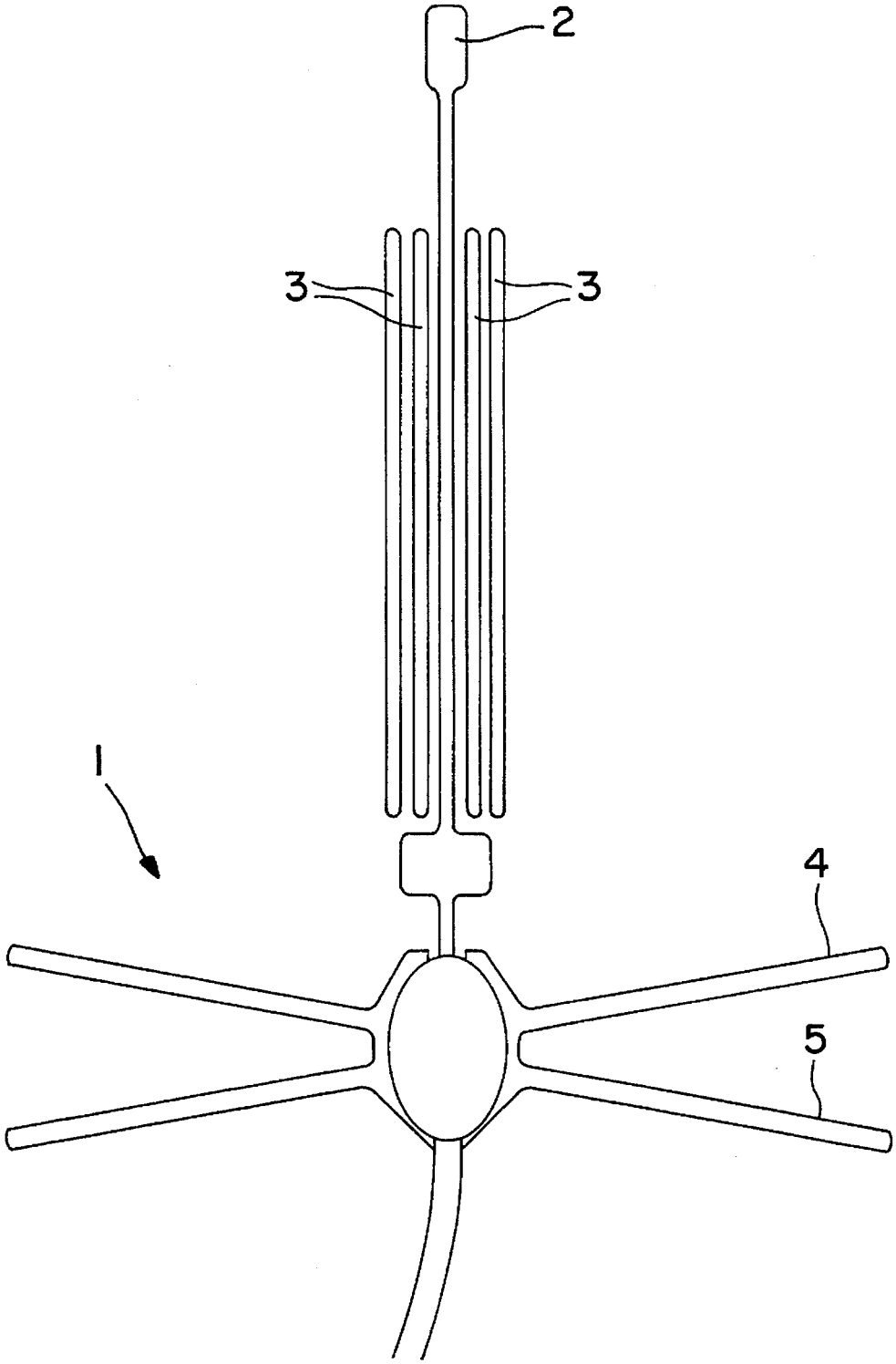
FIG. 2 shows an antenna in accordance with an other embodiment of the invention.

An other embodiment of the antenna construction according to the invention is illustrated in FIG. 2. The antenna of this figure is otherwise of the same construction as the antenna described in FIG. 1, but the grounding elements have bee accomplished slightly differently. In this second embodiment the grounding elements 4 and 5 cross each other in the vicinity of the connecting end of the vertical radiator 2, whereby these elements form a flattened X-shape configuration.

The antenna in accordance with the invention is also advantageous from the point of view of manufacturing technique as it possesses good recurrence; that is to say, each manufactured antenna is sufficiently identical. This is due to the structure of the antenna; all elements in it can be defined quite precisely and they are easy to execute.

Since the metal parts of motor vehicles cause some disturbance in the 450 MHz frequency, the user may wish to install two antennas—one onto either side window—and thereby achieve an enhanced radiation pattern and audibility. The audibility achieved by this solution is at least as good as that achieved by the best prior art radiator mounted in the middle of the roof of a motor vehicle. In the case of the 900 MHz mobile telephone frequency, there is no need for this because the higher frequency employed in the 900 MHz (or 950 MHz) mobile telephones means that the antenna is not adversely influenced by the body of the motor vehicle in the same way that it is with 450 MHz mobile telephones. Consequently, one antenna mounted on one side window is sufficient.

The standing wave ratio of this kind of an antenna is 1:1. This means that the precise length of the antenna cable, for instance, is of no significance. This being so, it is easy to install several antennas side by side when necessary.

To facilitate access to satellites, two antennas may be used with one installed on a side window of the motor vehicle and the other on either the windscreen or the rear window. This results in horizontally polarized circular polarization.

Etching, lamination or some other means may also be used to embed the antenna into the window of the motor vehicle.

Instead of using tape, the antenna can also be manufactured using thin wire installed onto the surface of the glass or embedded into the glass. However, if this is done, the antenna becomes considerably more difficult to manage, especially in the case of the surface mounting alternative. The cylindrical conductor on the surface of the glass leads to imprecisions of varying extent and these in turn mean, for example, reduced recurrence at the manufacturing stage.

Figure 3:
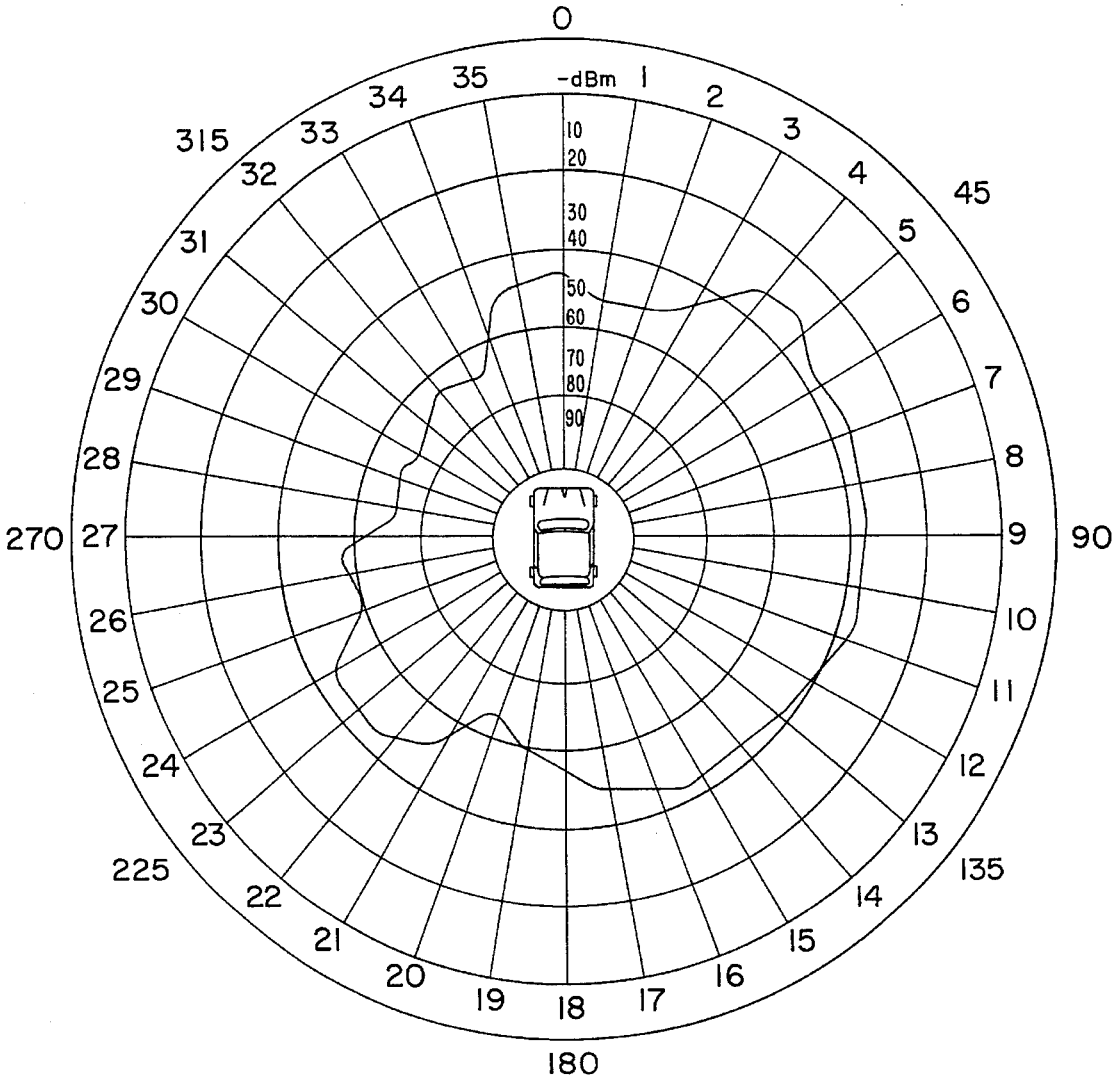
FIG. 3 shows the horizontal directional diagram of the antenna in accordance with the invention.

FIG. 3 shows the horizontal radiation diagram of the antenna shown in FIG. 1. The antenna was located on the right rear side window of the motor vehicle while the measurements were made.

Figure 4:
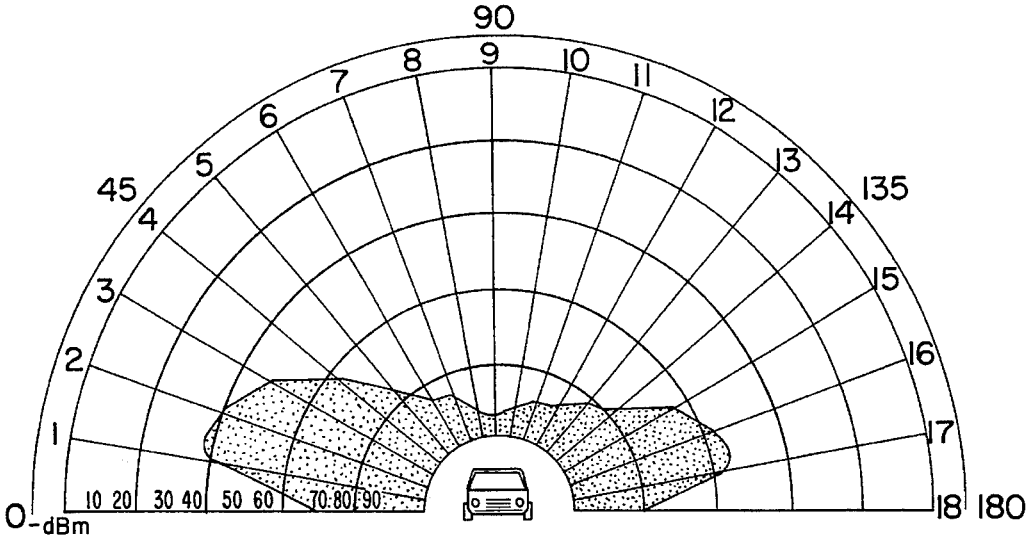
FIG. 4 shows the corresponding vertical directional diagram and FIG. 5 shows the antenna's impedance as a function of the number of auxiliary elements.

FIG. 4 shows the corresponding vertical radiation diagram.

As becomes evident from FIGS. 3 and 4, the radiation patterns of the antenna in accordance with the invention are quite advantageous and easily fulfil the requirements imposed on mobile telephone antennas as defined at the beginning of this description.

Figure 5:
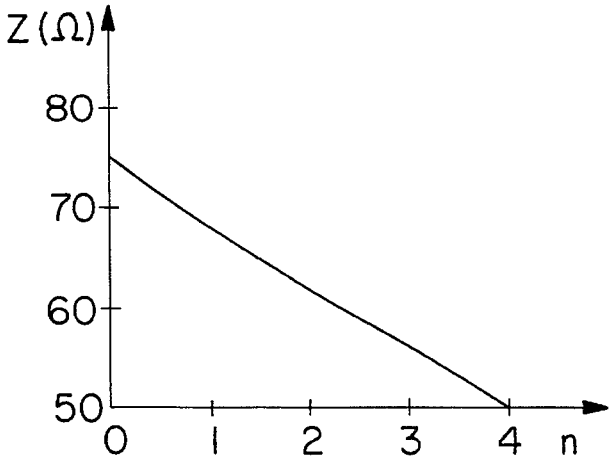

FIG. 5 shows the influence of the parasitic elements 3 on the impedance of the antenna. Without the parasitic elements 3, the antenna's impedance Z is approximately 75 ohms. The impedance of the antenna as shown in FIG. 1, with four parasitic elements 3, two on each side of the radiator 2, is exactly 50 ohms at the resonance frequency and the antenna impedance's reactive part is also zero.

I claim:

1. An antenna for transmitting and receiving a radio frequency signal for mounting on a window of a vehicle and adapted to connect to an antenna cable comprising:

a vertical radiator element of electrically conductive material having a length of at least ½ wavelength of said radio frequency signal and a substantially smaller width than said length as well as a connecting end at one end thereof, said connecting end adapted to be connected to a conductor of said antenna cable;

grounding elements having a width substantially the width of said vertical radiator element, said grounding elements spaced from said vertical radiator so as not to contact said vertical radiator element, and extending substantially horizontally in a direction away from the connecting end of the vertical radiator element in opposite directions for a distance of about ⅛ to ½ of the antenna wavelength; and at least one parasitic element of electrically conductive material, having a width of the order of the width of the vertical radiator element, extending parallel with the vertical radiator element at a distance from the vertical radiator element substantially equal to the width of the parasitic element, and spaced apart from said grounding elements to avoid a connection therewith.

2. An antenna according to claim 1, wherein the grounding elements comprise first elements and second elements, the first elements being spaced closer to the vertical radiator element than said second elements.

3. An antenna according to claim 2, wherein said first and second grounding elements are parallel to each other.

4. An antenna according to claim 2, wherein said first grounding elements project in an angle upwards from the connecting end of the vertical radiator element, and the second elements project at substantially the same angle downwards from the connecting end of the vertical radiator element.

5. An antenna according to any of claim 2, 3 or 4, wherein the first grounding elements are shorter than the second elements.

6. An antenna according to claim 1, wherein the vertical radiator has a length of ¾ wavelength of the radio frequency signal.

7. An antenna according to claim 1, having first and second parallel parasitic elements on each side of the vertical radiator element, each of the parasitic elements having substantially equal dimensions, and a spacing between each other of substantially the width of each element.

8. A radio telephone antenna for mounting on a window of a vehicle for transmitting and receiving a signal having a wavelength $\lambda$ comprising:

a vertical radiator element having a length of $0.63\times\lambda$ millimeters, a width in the range of approximately 2 to 4 millimeters, and a connecting end at one end;

a ground element of conductive material having a width substantially the same as the width of said vertical radiator element, and extending in opposite directions from the connecting end of the vertical radiator element without contacting the radiator element, a distance of substantially $0.215\times\lambda$ millimeters; and, a parasitic element of electrically conductive material on each side of said vertical radiator element, having a width of the order of the width of the vertical radiator element, and extending parallel with the vertical radiator element at a distance from the vertical radiator element essentially equal to the width of the parasitic element, extending from a distance of $0.093\times\lambda$ millimeters from the ground element to a height of essentially $0.093\times\lambda$ millimeters from the end of the vertical radiator element opposite said connecting end.

* * * * *